US005380127A

United States Patent [19]

Caleix et al.

[11] Patent Number: 5,380,127

[45] Date of Patent: Jan. 10, 1995

[54] NON-ENTRY METHOD OF UNDERGROUND EXCAVATION IN WEAK OR WATER BEARING GROUNDS

[75] Inventors: Clovis Caleix, Saint-Cloud, France; Jean-Luc Narcy, Nedlands, Australia

[73] Assignees: Cigar Lake Mining Corporation, Saskatchewan, Canada; Cogema, France

[21] Appl. No.: 31,617

[22] Filed: Mar. 15, 1993

[51] Int. Cl.[6] ..... E02D 19/14

[52] U.S. Cl. ..... 405/130; 299/11; 299/16; 405/55; 405/138

[58] Field of Search ..... 405/136, 137, 130, 144, 405/141, 138, 132; 299/11, 16

[56] References Cited

U.S. PATENT DOCUMENTS

| | | | |
|---|---|---|---|
| 711,012 | 10/1902 | Sooysmith | 405/130 X |
| 713,165 | 11/1902 | Sooysmith | 405/130 |
| 721,830 | 3/1903 | Perin | 405/130 |
| 736,308 | 8/1903 | Sooysmith | 405/130 |
| 3,299,643 | 1/1967 | Mauclet | 405/130 |
| 3,528,252 | 9/1970 | Gail | 405/130 |
| 4,516,878 | 5/1985 | Rebhan | 405/130 |

FOREIGN PATENT DOCUMENTS

| | | |
|---|---|---|
| 117609 | 4/1909 | Canada . |
| 344521 | 9/1934 | Canada . |
| 719165 | 10/1965 | Canada . |
| 742588 | 9/1966 | Canada . |
| 857585 | 12/1970 | Canada . |
| 957854 | 11/1974 | Canada . |
| 1018556 | 10/1977 | Canada . |
| 1049052 | 2/1979 | Canada . |
| 1135731 | 11/1982 | Canada . |
| 1152114 | 8/1983 | Canada . |
| 1236004 | 5/1988 | Canada . |

OTHER PUBLICATIONS

Brochure entitled "Terrafreeze", undated 11 pages, published by the Terrafreeze Corporation.

Document entitled "Some Notes On Concreting Against Frozen Earth", Shuster, J. A., Braun, B., undated, 8 pages, published by the Terrafreeze Corporation.

*Primary Examiner*—Dennis L. Taylor

*Attorney, Agent, or Firm*—Willian Brinks Hofer Gilson & Lione

[57] ABSTRACT

A method of excavating an underground area liable to flooding or collapsing during excavation, wherein the area is susceptible to disaggregation by high pressure water jet and is located above rock of strength suitable for drifting a gallery comprises drifting a gallery in the rock beneath the area, freezing at least a perimeter of the area to form a frozen perimeter, and excavating material from within the frozen perimeter using a high pressure water jet and one or more boreholes between the gallery and the area. Preferably the whole area is frozen for excavation.

20 Claims, 3 Drawing Sheets

NON-ENTRY METHOD OF UNDERGROUND EXCAVATION IN WEAK OR WATER BEARING GROUNDS

The present invention concerns a novel method of excavating to form an underground cavity in weak or water bearing grounds. The purpose of the excavation could be to mine an are body, or to create a cavity for storage or disposal, or to reinforce or anchor a civil engineering work. The method has been developed to mine ore from a specific uranium deposit beneath Cigar Lake in Saskatchewan, Canada, and due to the hazards of uranium the inventive method avoids human entry into the deposit area. However, the method clearly has broader applications as stated above. In the discussion which follows the invention is typically characterized by reference to the mining method embodiment, but this is not intended to be limiting. For example, if reference is made to a "mineral deposit" or "ore body", this could be replaced with "storage/disposal area host rocks" or "anchoring zone rocks" and be within the scope of the present invention.

In a mining context, a problem exists whenever a mineral deposit is overlaid for example, by upper country rock having weak geotechnical characteristics, e.g. being highly permeable, fractured, saturated with groundwater, or possibly having water beating fissures connected to surface water (a lake). Considerable hydrostatic pressure could develop, increasing the potential for a sudden and large water inrush when opening a cavity in the mineral deposit. Even in the absence of high hydrostatic pressure, weak rock could collapse into a cavity during excavation.

One possible solution when hydrostatic pressure is of concern, is to pump water away from the mining area, but this will not work satisfactorily for deposits subject to high hydrostatic pressure, e.g. 45 bar.

The present invention has been developed to help alleviate the above concerns.

SUMMARY OF THE INVENTION

The invention provides a method for excavating an underground area, such as a mineral deposit, which is liable to flooding or collapse during excavation. The method is applicable when the area is susceptible to disaggregation by high pressure water jet and is located above rock, e.g. lower country rock, that has strength suitable for the drifting of a gallery, and the method includes drifting a gallery in such rock and beneath the area for excavation. The lower country rock may be in close contact with the bottom of the excavation area or at a relatively deep elevation. Groundwater seepage in the lower country rock may be controlled by grouting. Under the method of the invention, at least a perimeter of the area for excavation is frozen and then material is excavated from within the perimeter, e.g. so that the excavation does not extend outside the perimeter thereby creating a conduit for flooding water into the area. The frozen perimeter acts as a barrier to water flooding into the area under excavation. Access to the area is obtained by access means, e.g. one or more boreholes, between the gallery and the area. In a preferred aspect of the method, the whole area for excavation is frozen before the area is excavated, not just the perimeter.

The method includes using a high pressure water jet for excavation of the area. Water from the jet may be hot so as to cause thermal fracturing of the material in the area. The jet may be controlled so that the size of the excavation cavity can be controlled. For example, the pressure or direction of the jetting action may be vaned as desired. Also, preferably, cuttings from the jet are flushed, with or without augering, out of a cavity formed in the area and gravity delivered to the gallery below.

The freezing may be achieved by providing a plurality of freezing means, preferably boreholes containing freezepipes, around a perimeter of the area, the means being in number and location predetermined to be sufficient to effect the freezing. The freezing may be extended above and below the area by providing the freezing means into such locations.

The present invention will now be described with reference to the figures and preferred embodiments.

Figure 1:
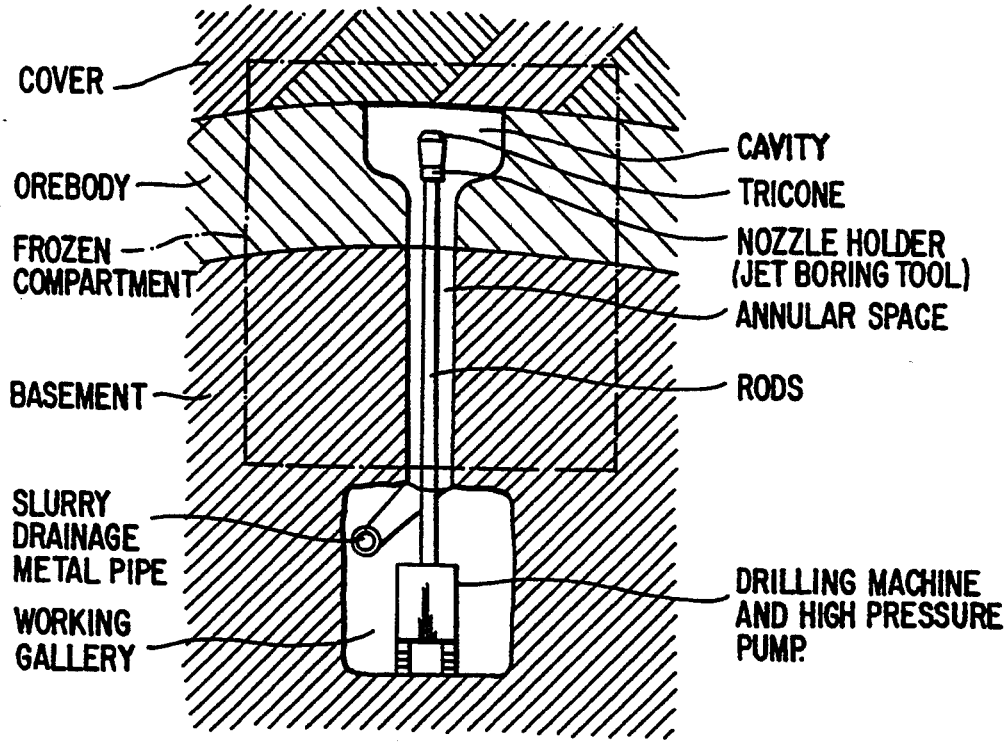
FIG. 1 is a cross sectional view of part of an ore deposit being mined by the method of the invention.

In the above described drawings it is assumed that contact zones between each rock type are horizontal, which may vary. Bore holes for freezing and mining would therefore be inclined to fit the new geological pattern.

DETAILED DESCRIPTION OF THE PREFERRED EMBODIMENTS

The inventive method allows for the excavation ( for mining or creating cavities) of an underground area, such as a mineral deposit, in a safe manner in the geological context of hydrogeological features and rock types described above, which are conducive to flooding or collapse during such excavation. Techniques applied and combined to achieve that in a preferred mining operation include:

(a) Freezing of a portion of the mineral deposit area to be excavated prior to mining. The portion is preferably frozen entirely, but may be selectively frozen at its perimeter only;

(b) Freezing of surrounding country rocks to overcome the potential for uncontrolled water inrush;

(c) Development work by drifting headings at an elevation underneath the area where mining is to take place;

(d) The use of upward bore hole drilling to access the area for mining;

(e) Using high pressure jet boring of the frozen area for mining, preferably using hot water to cause thermal fracturing and thereby assist disaggregation of the material in the area;

(f) Flushing, with or without augering, cuttings out of the cavity created;

(g) Backfilling the cavity if appropriate, e.g. if necessary for completing a mining cycle when the method is being used to mine a mineral deposit.

In order to allow a continuous mining operation, and because it takes time to freeze a block of ground, the sequences in mining a formation should be carefully scheduled so that the various mining phases, having regard to their duration, are coordinated to alleviate production disruption. These phases include: the preparation work (drifting of galleries) to access new mining areas; freezing of predetermined blocks of orebody; and switching between mining and backfilling in the active area. The scheduling of these and other mining phases is recommended for an efficient mining operation, but is not necessary for operating the method of the invention.

In the present method, freezing is used to control underground water movement and thereby provide safer conditions for mining. Freezing also gives more geotechnical strength to otherwise weak material which could collapse (if not frozen) when opening cavities. To freeze a block of ground, i.e. the area where mining is to take place, preferably bore holes are drilled and freezepipes are inserted in the boreholes in a pattern which envelopes the area. This can be achieved in two ways: firstly, by freezing blocks of ground, each face of each block being materialized by a row of freezepipes from which a frozen wall can develop progressively; or secondly, by using a regular pattern of freezeholes intersecting the mineral deposit, extending beyond the upper and lower limits of the deposit, the distance between each freeze hole allowing freezing of the ground to develop homogenously. Both methods should result in frozen upper and lower waste rock layers acting as watertight barriers, and the mineral deposit itself being frozen. Further to either freezing method, mining should take place inside the frozen area, respecting the integrity of the frozen boundary walls to ensure a safe operation. Although freezing of the entire active mining area is preferred, it is feasible to freeze only the perimeter of the active mining area as this should suffice to prevent collapse or the influx of water (flooding) into the area during mining.

Depending on the specifics of the mineral deposit geometry, it will be apparent that different freezing patterns can be adapted and implemented from galleries located either above, or underneath the mineral deposit or even laterally to it.

It will be apparent from the above description of the geotechnical characteristics of the kinds of areas most suitable for the inventive method that the excavation must be performed from underneath a mineral deposit or area for cavity formation, where safer ground conditions prevail. In view of this, slurry handling can be achieved easily by gravity.

High pressure water (preferably hot water to develop thermal fracturing of the material to be excavated) from a jet boring tool is preferably used to excavate a deposit in a repetitive mining cycle. Ore slurry flow out of a cavity formed is preferably gravity fed to a gallery below, and is further preferably controlled by a flushing system, e.g. varying flushing water flow through an auger rod system topped by the jet boring tool. The jet boring tool and auger rod system preferably allow for the delivery of two pressure fluids to the excavation site; one fluid is at high pressure for ore cutting delivery from the jet boring tool nozzles, and the other fluid is for release from the jet boring tool and auger rod to aid in flushing cuttings into the borehole. Many different kinds of available jet boring tools and auger rods could be used to facilitate the excavation of ore under the present method. Selection of the most appropriate equipment will normally be determined by the prevailing geotechnical characteristics of the area to be excavated.

Size of the cavity may be controlled by varying the jetting parameters and modifying the jetting head kinematics that govern the jetting action distance. Because the jet action may be directed, a high level of selectivity is possible.

A survey tool may be used to exercise quality control over the result of jet boring.

Ore produced in slurry form by the method of the invention facilitates ore handling and allows for a high degree of containment of the material mined should such be hazardous (e.g. radioactive).

A typical (exemplary) sequencing of a mining phase under the inventive method could be as follows:

(a) Drifting of galleries underneath a mineral deposit to access virgin ore zones and to prepare a freeze hole pattern;

(b) Freezing a block of the deposit;

(c) Exploiting ore from an active area where mining alternates with backfilling until depletion of ore from the area;

(d) Discontinuing freezing in an already mined-out and backfilled area.

The present invention resulted from consideration of the problems posed by the uranium ore deposit at Cigar Lake, Saskatchewan. Such deposit lies underground, deep beneath Cigar lake. There is a layer of sandstone about 450 meters thick between the top of the deposit and the bottom of the lake. The deposit has high grade ore, on average 100 kg/ton, and a high level of natural radioactivity. The rock of the deposit is poorly consolidated, i.e. loose and highly clay-like, hosted in geotechnically weak formation. Hydrostatic pressure is high, at about 45 bar. Such pressure may result in an inflow of several thousand cubic meters of water per hour upon removal of ore, unless the method of the invention is practised.

Figure 2:
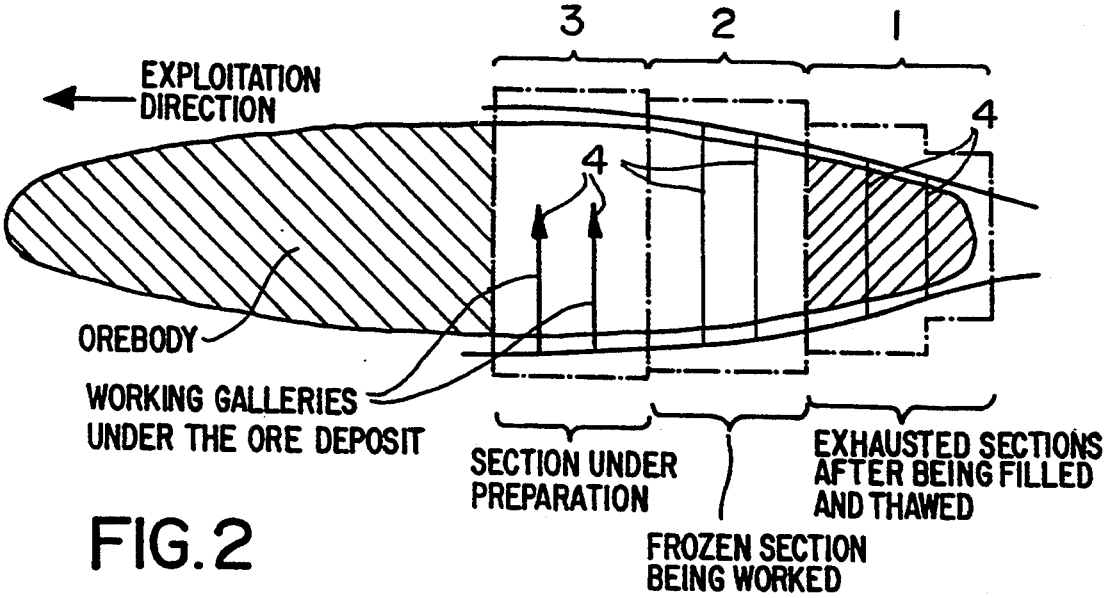
FIG. 2 is a view of an ore deposit from above showing a pattern of exploitation of the deposit in accordance with a preferred aspect of the invention.
Figure 3:
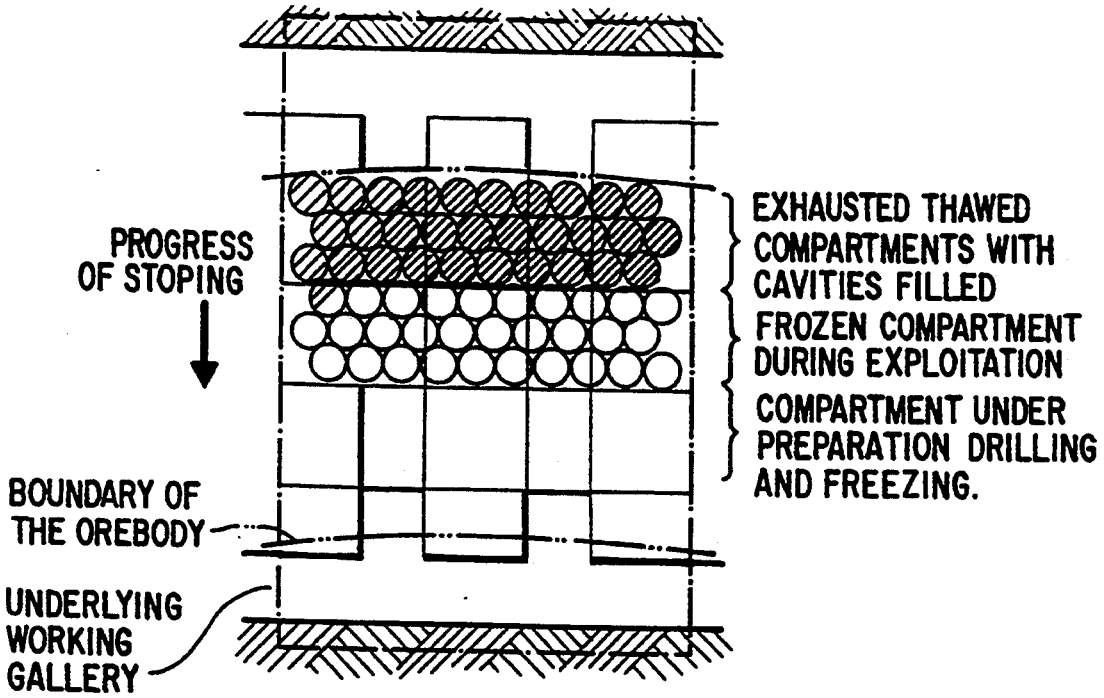
FIG. 3 is a plan view of an area of an ore deposit being mined in a sequence in accordance with a preferred aspect of the method of the invention.

In a preferred aspect of the invention, a mining sequence is used which firstly comprises excavating working galleries under a first section 1 (see FIG. 2) of the orebody, perpendicular to its length. In the Cigar Lake operation this provides access to the first section 1 which will take about 1–2 years to mine. A working gallery is shown in FIG. 1, and a series of such galleries 4 is shown in FIG. 2, i.e. pairs of galleries for mining first and successive sections of the orebody (i.e. 1, 2, 3).

Figure 4:
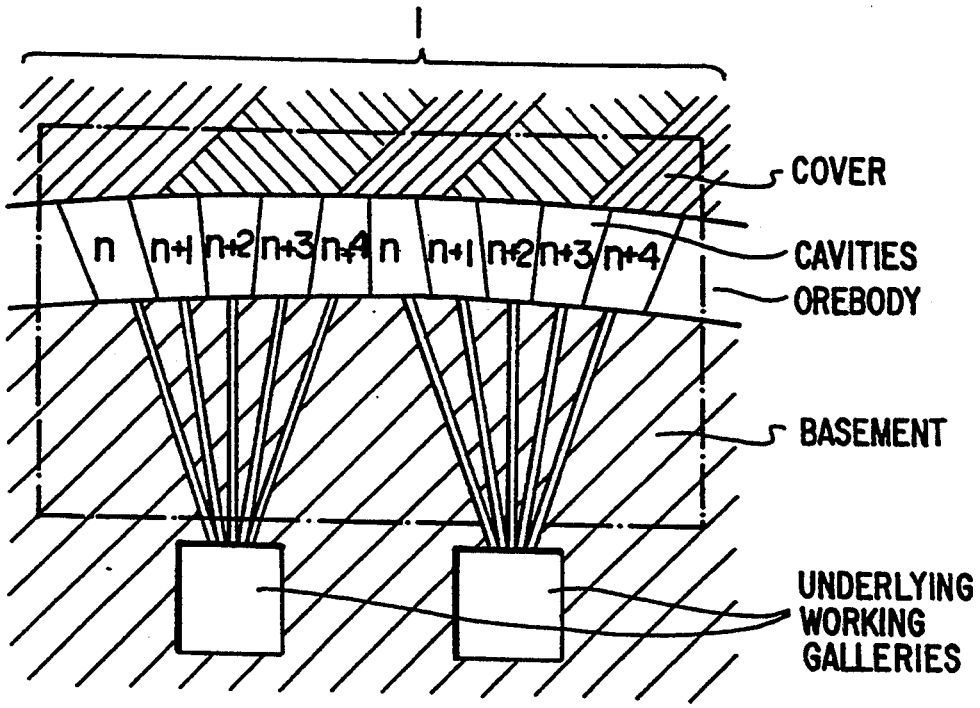
FIG. 4 is a cross sectional view of a zone of an ore deposit being mined in accordance with a preferred aspect of the present invention.
Figure 5A:
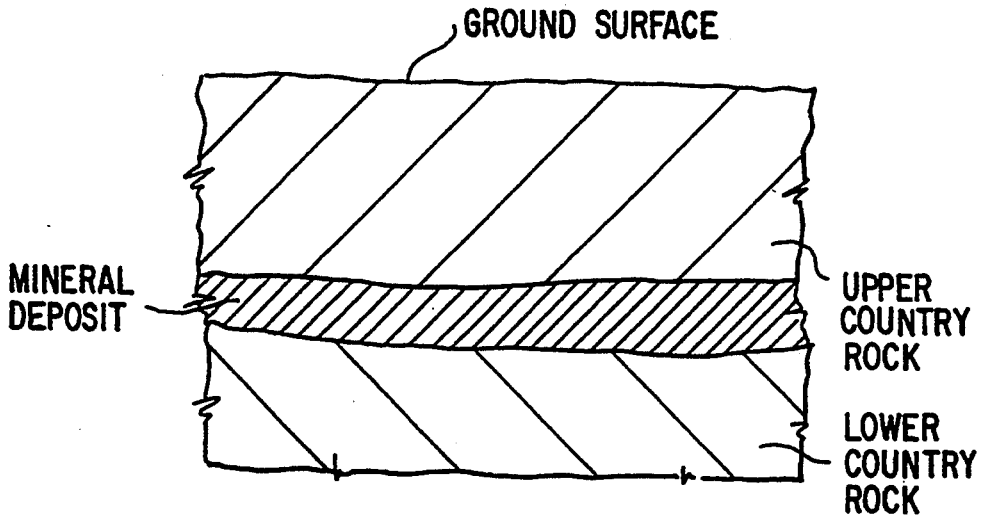
FIGS. 5*a*, 5*b* and 5*c* show cross sectional views of three different general kinds of ground formations in which application of the present method would be suitable.
Figure 5B:
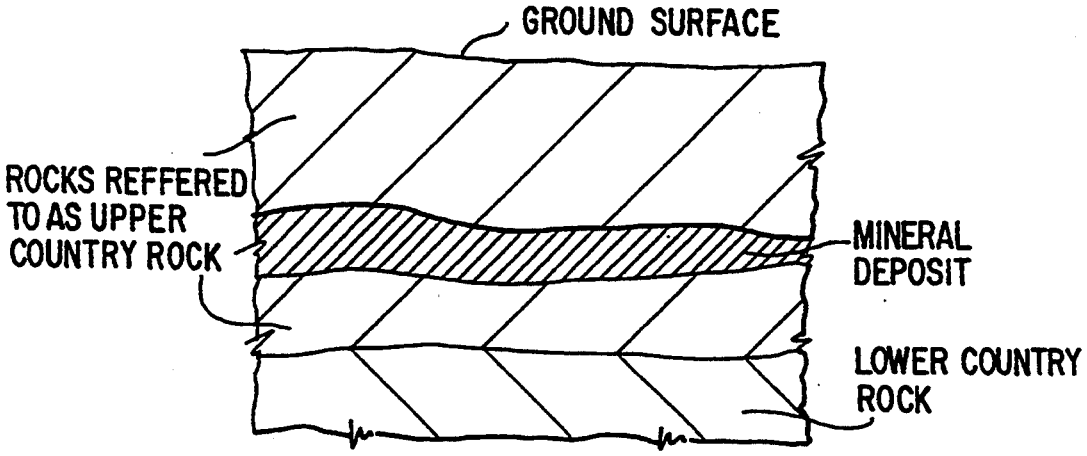
Figure 5C:
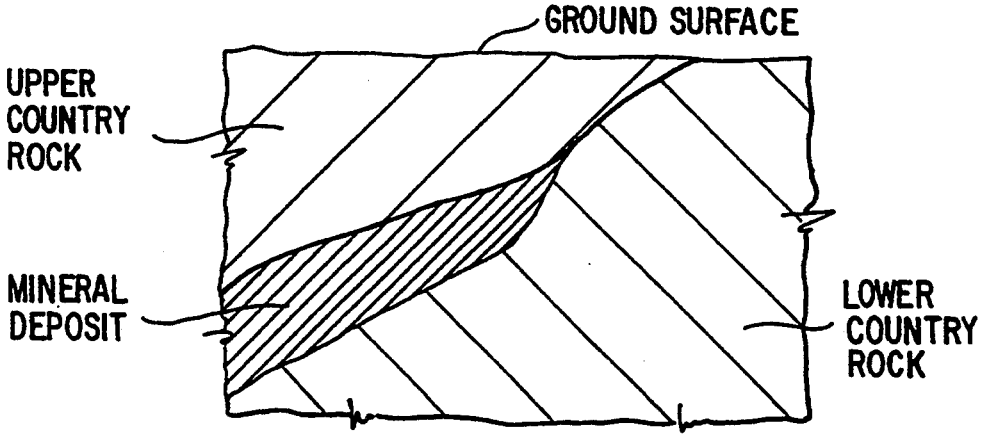

Boreholes are made from the working galleries upwards to the first section 1, preferably in a fan-shaped array. Freezing is then applied via the boreholes to freeze the section 1. Some of the same and/or new boreholes are then used to access a plurality of working zones in the section 1, from the galleries. A high pressure water jet tool is placed in a first working zone "n" (see FIG. 4) and operated so as to break down ore in the zone. Preferably, the water jet tool delivers hot water under high pressure in one or more jet streams. The direction and pressure of the streams can be controlled so that, for example, size, direction and speed of the excavation can be highly selective. Low pressure flushing water is also delivered from the water jet tool and from nozzles along the drilling rod (which may be an auger rod so that augers can assist the breakdown and movement of ore into the borehole). Broken down ore is delivered by gravity in a slurry with water from the water jet tool and drilling rod (with or without augers), to a gallery via one or more boreholes. The slurry exits the borehole while under containment, e.g. in an enclosed conveyor such as a pipe, so that workers in the gallery are not exposed to the slurry.

When the zone n is mined out, the cavity formed is backfilled with material that will prevent a collapse of the cavity when freezing is eventually removed from the section. The next working zone n+2, some distance from zone n, is then worked in the same manner as for the zone n. When zone n+2 is mined out and backfilled, the next zone n+4, again some distance from the most recently mined out and backfilled zone n+2, is worked. By avoiding mining a zone adjacent a freshly mined out and backfilled zone, the risk of cave in is minimized. In referring to FIG. 4, and continuing with the above sequence, zone n+1 is worked after zone n+4 is mined out and backfilled. Zone n+3 is then worked after zone n+1 is mined out and backfilled. When all working zones in the section 1 are mined out and backfilled, the galleries are backfilled as well.

Preferably before the first section of the orebody is mined out and backfilled, the second section 2 of the orebody is prepared for mining by constructing galleries beneath the section, making boreholes upwards from the galleries to the second section and freezing the section in the same manner as was used for the first section. Then when the galleries used for exploitation of the first section are backfilled upon completion of the mining of the first section, mining of the second section begins and proceeds in the same manner as was used for the first section. The freezing of the first section may be removed once cavities in the worked out zones and the galleries have been backfilled and, if appropriate, filling material has set, e.g. in the case of cement, or the like.

When the second section 2 has been mined out and backfilled, mining of the third section 3 may begin. Preferably the third section has been frozen, in preparation for mining, before the mining of the second section has been completed. The second section may be allowed to thaw after cavities and galleries have been filled with supporting material.

Thus, typically during the exploitation of an orebody using the present method, there is a frozen section under active mining, a previously mined adjacent section in which cavities and associated galleries have been backfilled and from which freezing may have been removed, and an adjacent section which is under preparation for mining, i.e. for which excavation of galleries and freezing of the section is underway. An orderly progression of the mining of sections in this manner will result in the mining of the orebody in a direction of from one end of the orebody to the other end.

The number of boring and mining (water jet) machines, the location and network of freezing boreholes, and the distance between the galleries are determined according to technical considerations and economic calculations. At Cigar Lake, two systems, i.e. two galleries, with a throughput of 10 tons/hour at 10 hours/day each, are sufficient for an extraction rate of 200 tons/day.

Preferably two galleries are operated in a working zone simultaneously. A typical distance between the galleries is 18 m with a 2.60 m×3 m grid for the freezing and injection boreholes.

Each zone is mined by a high pressure water jet that preferably rotates and excavates continuously. Ore loosened by the water jet forms a slurry with water from the water jet and flushing system, and the slurry is gravity fed, with or without direction by a grinding auger, into the annular space of the borehole. The grinding auger, if used, assists in clearing the zone of ore broken down by the water jet. The slurry is drawn off by gravity preferably through a metal pipe in the borehole. Power units for the water jet, the auger and water flushing system are preferably located in the gallery.

Ore delivered to the underlying gallery may be broken before hydraulic transportation or air lift transfer to the surface.

The inventive method is well suited to the excavation of a radioactive orebody, in that miners can excavate the orebody without coming into contact with the ore. The working galleries are excavated in rock below the orebody. Ore is extracted from the borehole through a metal pipe with no release of radioactivity. The pipe provides a barrier against gamma radiation, radon and dust. Each zone is excavated remotely using the water jet tool, with ore being fed to the metal pipe by gravity with or without the assistance of an auger. Ore in the gallery may be transferred to the surface in slurry form, through a metal pipe which contains radioactivity. Water may be drawn off and processed at the surface in a treatment plant close to the mill. The method may be termed a "Non Entry Mining Method" (NEMM) since it is clean in terms of radiation protection.

The description of the inventive method herein as applied to the Cigar Lake ore body, is intended to be illustrative only of one application of the method, and not a limitation to such ore body. Applications of the method to other orebodies and areas as described above for cavity formation are contemplated herein as would be understood by any person skilled in the art.

What is claimed is:

1. A method of excavating an underground area liable to flooding or collapsing during excavation, wherein said area is susceptible to disaggregation by high pressure fluid and is located above rock of strength suitable for drifting a gallery, which method comprises:

a) drifting a gallery in the rock of strength beneath the area, b) drilling a plurality of freezeholes from the gallery upwardly through the rock of strength, the area and beyond the area to be excavated, said plurality of freezeholes being sufficient in number and location to support freezing at least a perimeter of the area, c) freezing at least the perimeter of the area to form a frozen perimeter, d) while sustaining said frozen perimeter, drilling a borehole upwardly to within the frozen parameter and excavating material from within the frozen perimeter using a high pressure fluid, forming a slurry of excavated material, e) directing said slurry downwardly into a slurry conduit and f) conveying the slurry away from the excavation area.

2. A method of excavating an underground area liable to flooding or collapsing during excavation, wherein said area is susceptible to disaggregation by high pressure water jet and is located above rock of strength suitable for drifting a gallery, which method comprises:

a) drifting a gallery in the rock beneath the area, b) drilling a plurality of freezeholes from the gallery upwardly through the rock of strength, the area and beyond the area to be excavated, said plurality of freezeholes being sufficient in number and location to support freezing of the area, c) freezing the area, d) while sustaining freezing of the area, drilling a borehole upwardly to within the frozen area and remotely excavating material from within the area using a high pressure water jet, thereby forming a slurry of excavated material, e) remotely directing said slurry downwardly into a slurry conduit and f) conveying the slurry away from the excavation area.

3. The method of claim 2 in which water from the water jet is at a temperature sufficient to fracture the material thermally.

4. The method of claim 2 in which the area is beneath or surrounded by substantially water permeable rock.

5. The method of claim 2 in which the area is beneath or surrounded by weak rock susceptible to collapsing into the area when the area is excavated.

6. The method of claim 2 in which after excavation of the area is completed, a cavity in the area is backfilled and freezing is discontinued.

7. The method of claim 2 in which adjacent sections of the area are excavated in a sequence, and a substantially completely excavated section is backfilled before an adjacent section is excavated.

8. The method of claim 7 in which when one section is under excavation, an adjacent section is under freezing preparation for excavation.

9. The method of claim 8 in which also when the one section is under excavation, another section adjacent the section under excavation has been backfilled and is no longer subject to freezing.

10. The method of claim 7 in which the adjacent section is separated from the substantially completely excavated section by at least one unexcavated section or by another section substantially completely excavated and backfilled before the former said substantially completely excavated section was backfilled.

11. The method of claim 2 in which cuttings from the jet are flushed out of a cavity formed in the area and gravity delivered to the gallery.

12. The method of claim 11 in which the cuttings are also augured downward out of the cavity.

13. The method of claim 3 in which the freezing and jetting action of the water jet are controlled in such a manner as to excavate a cavity in the area of a preselected size.

14. The method of claim 13 in which the pressure and direction of the jetting action are remotely controlled.

15. The method of claim 1 in which the material in the area is health-hazardous, and said slurry conduit comprises a closed conveyance whereby human operators are prevented from contacting the slurry.

16. The method of claim 15 in which the material in the area is radioactive.

17. The method of claim 1 wherein first and second non-adjacent sections of the area are excavated, backfilled and the backfill is solidified and then a third section of the area between the first and second sections is excavated, all while the area remains frozen.

18. The method of claim 1 wherein the gallery is drifted directly beneath the area.

19. The method of claim 2 wherein the step of freezing the area includes freezing the rock of strength between the area and the gallery.

20. The method of claim 1 wherein the slurry conduit comprises the borehole and the slurry is directed first to the gallery and then out of the gallery to the surface.

* * * * *

UNITED STATES PATENT AND TRADEMARK OFFICE

CERTIFICATE OF CORRECTION

PATENT NO. : 5,380,127

DATED : January 10, 1995

INVENTOR(S) : Clovis Caleix et al.

It is certified that error appears in the above-indentified patent and that said Letters Patent is hereby corrected as shown below:

In column 1, line 9, delete "are" and substitute --ore--.

In column 1, line 28, delete "beating" and substitute --bearing--.

In column 2, line 5, delete "vaned" and substitute --varied--.

Signed and Sealed this

Sixteenth Day of March, 1999

*Attest:*

*Attesting Officer*

Q. TODD DICKINSON

*Acting Commissioner of Patents and Trademarks*